United States Patent [19]

Kinghorn

[11] Patent Number: 4,867,608

[45] Date of Patent: Sep. 19, 1989

[54] METHOD AND APPARATUS FOR REPAIRING SUBMERGED LINERS

[76] Inventor: Robert E. Kinghorn, P.O. Box 56, Woodlands, Wash. 98674

[21] Appl. No.: 309,374

[22] Filed: Feb. 13, 1989

[51] Int. Cl.[4] ..... B63C 11/00; E02B 3/00

[52] U.S. Cl. ..... 405/188; 405/52; 405/194; 405/270

[58] Field of Search ..... 405/11–14, 405/52, 60, 63, 185, 188, 194, 203, 205, 270

[56] References Cited

U.S. PATENT DOCUMENTS

| | | | |
|---|---|---|---|
| 4,047,390 | 9/1977 | Boyce . | |
| 4,283,159 | 8/1981 | Johnson et al. | 405/60 |
| 4,373,834 | 2/1983 | Grace | 405/60 |
| 4,735,524 | 4/1988 | Dunkers | 405/63 |
| 4,806,435 | 2/1989 | Athey | 405/270 X |

*Primary Examiner*—David H. Corbin

*Attorney, Agent, or Firm*—Neal J. Mosely

[57] ABSTRACT

A working chamber is placed in a lined pond containing a body of contaminated water and filled with clean water to safely isolate divers while they repair damaged areas of the liner. The chamber is an open ended housing having a side wall of water impervious material configured to surround the area of liner damage and a height greater than the depth of the body of water at the repair site. Buoyancy tanks float the housing in a stable upright position above the repair site and are filled with clean water to sink the housing to rest its bottom end on the liner at the bottom of the body of water. A deformable seal on the bottom end of the housing engages the liner surface surrounding the area of liner damage and is filled with water to forming a substantial water sealing relation therewith but with controlled leakage. Clean water is conducted into the chamber interior at a predetermined rate to displace contaminated water inside the chamber. A pump may also be utilized to remove contaminated water from the interior of the chamber. The inlet rate and leakage or removal rate are controlled to provide a column of continuous clean water within the chamber sufficiently safe for human divers to enter the chamber and repair the damaged liner. After the repair, the buoyancy tanks and bottom seal are filled with air and the chamber may be floated to another location or removed.

19 Claims, 4 Drawing Sheets

METHOD AND APPARATUS FOR REPAIRING SUBMERGED LINERS

BACKGROUND OF THE INVENTION

1. Field of the Invention

This invention relates generally to underwater repair apparatus and methods, and more particularly to a method and apparatus for repairing synthetic liners of hazardous waste pits and ponds.

2. Brief Description of the Prior Art

The federal Environmental Protection Agency (EPA) and various state environmental agencies have mandated certain containment and emission requirements for the containment of "hazardous products". The term "hazardous" may refer to a cancer causing product, a poison, or even salt water (brine).

A common state of the art system for containment of restricted liquids utilizes synthetic plastic liners placed as an impermeable membrane over an excavated earthen structure to form a holding pond or pit. The plastic liner may be placed over the earth or a layer of concrete lining the excavation. The assumption is that the synthetic liner will not leak and the fluid will be contained. Often the lined pond or pit is integrated into a system where it is impractical to remove the hazardous liquid to repair the liner in the event of failure. The present invention addresses the problem of repairing such a pond liner in the event of failure of the liner.

There are several patents which disclose apparatus and methods for isolating one section of water from another.

Robinson, U.S. Pat. No. 294,078 discloses a caisson used for casting a concrete pier.

Rebikoff, U.S. Pat. No. 3,380,256 discloses an open top caisson which is sunk into water with the top extending above the surface of the water. The water is then pumped out of the caisson so that a drilling rig can be installed on the bed of the body of water.

Preus, U.S. Pat. No. 4,100,746 discloses an aquatic sports area with boundaries divided by skirts of waterproof sheet material extending from the surface to the bottom to protect the swimming areas.

Salisbury, U.S. Pat. No. 3,078,472 discloses a floating swimming pool which protects swimmers from hazards which has floating edges and a plastic bottom. The entire structure is floated on a body of water and is filled with clean fresh water.

Williamson, U.S. Pat. No. 1,017,486 discloses a diving apparatus with a bell or caisson which is submerged to the bottom of a body of water and is connected by a flexible tubing to a vessel on the surface.

Blanc, U.S. Pat. No. 4,724,790 discloses a submersible diving bell which can be pumped free of water and secured to the bottom of a body of water.

Leary, U.S. Pat. No. 4,362,437 discloses an apparatus for working on a submerged surface such as the hull of a ship. The apparatus includes a liquid type enclosure with an arrangement for the hands of the worker to extend into the enclosure for working in a water-free environment.

The present invention is distinguished over the prior art in general, and these patents in particular by a working chamber which is placed in a lined pond containing a body of contaminated water and filled with clean water to safely isolate divers while they repair damaged areas of the liner. The chamber is an open ended housing having a side wall formed of water impervious material configured to surround the area of liner damage and has a height greater than the depth of the body of water at the repair site. Buoyancy tanks on the housing allow the housing to float in a stable upright position above the repair site and are filled with clean water to sink the housing to rest its bottom end on the liner at the bottom of the body of water. A deformable seal on the bottom end the housing engages the liner surface surrounding the area of liner damage and is filled with water to forming a substantial water sealing relation therewith but with controlled leakage. Clean water is conducted into the chamber interior at a predetermined rate to displace contaminated water inside the chamber. A pump may also be utilized to remove contaminated water from the interior of the chamber. The inlet rate and leakage or removal rate are controlled to provide a column of continuous clean water within the chamber sufficiently safe for human divers to enter the chamber and repair the damaged liner. After the repair, the buoyancy tanks and bottom seal are filled with air and the chamber may be floated to another location or removed.

SUMMARY OF THE INVENTION

It is therefore an object of the present invention to provide an apparatus and method for repairing the liners of hazardous waste pits and ponds without the necessity of emptying the pit or pond.

It is another object of this invention to provide an apparatus and method for repairing the liners of hazardous waste pits and ponds which utilizes a positive flow of clean water inside an isolation chamber to provide a safe working environment for humans to perform the repair operations.

Another object of this invention is to provide an apparatus and method for repairing the liners of hazardous waste pits and ponds which utilizes a positive flow of clean water inside an isolation chamber to provide improved visibility for humans to perform the repair operations.

Another object of this invention is to provide an apparatus for repairing the liners of hazardous waste pits and ponds which may be preconstructed or preassembled at the job site.

Another object of this invention is to provide an apparatus for repairing the liners of hazardous waste pits and ponds which may be floated to the location above the section of the liner to be repaired and then sunk to the bottom to surround the failure in the liner.

A further object of this invention is to provide an apparatus and method for repairing the liners of hazardous waste pits and ponds which will effectively seal off the area surrounding the section of liner to be repaired and provide a barrier between clean water in the working environment and the surrounding hazardous water.

A still further object of this invention is to provide an apparatus for repairing the liners of hazardous waste pits and ponds which is simple in construction, economical to manufacture, and rugged and reliable in use.

Other objects of the invention will become apparent from time to time throughout the specification and claims as hereinafter related.

The above noted objects and other objects of the invention are accomplished by a working chamber which is placed in a lined pond containing a body of contaminated water and filled with clean water to safely isolate divers while they repair damaged areas of the liner. The chamber is an open ended housing having a side wall formed of water impervious material configured to surround the area of liner damage and has a height greater than the depth of the body of water at the repair site. Buoyancy tanks on the housing allow the housing to float in a stable upright position above the repair site and are filled with clean water to sink the housing to rest its bottom end on the liner at the bottom of the body of water. A deformable seal on the bottom end the housing engages the liner surface surrounding the area of liner damage and is filled with water to forming a substantial water sealing relation therewith but with controlled leakage. Clean water is conducted into the chamber interior at a predetermined rate to displace contaminated water inside the chamber. A pump may also be utilized to remove contaminated water from the interior of the chamber. The inlet rate and leakage or removal rate are controlled to provide a column of continuous clean water within the chamber sufficiently safe for human divers to enter the chamber and repair the damaged liner. After the repair, the buoyancy tanks and bottom seal are filled with air and the chamber may be floated to another location or removed.

DESCRIPTION OF THE PREFERRED EMBODIMENT

Figure 1:
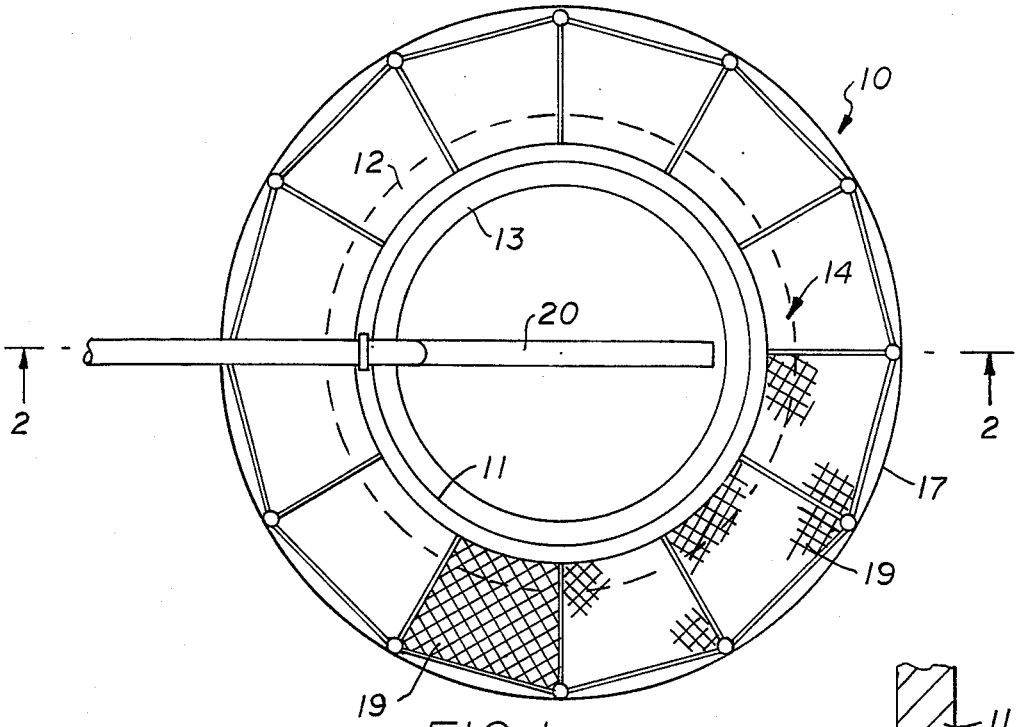
FIG. 1 is a top plan view of an isolation chamber in accordance with the present invention.
Figure 3:
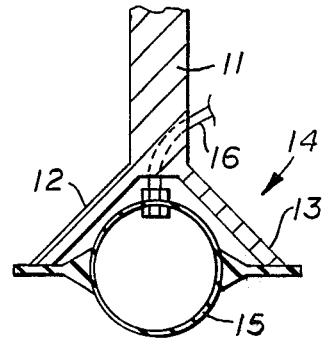
FIG. 3 is a partial cross section of the base seal of isolation chamber in the unfilled condition.
Figure 2:
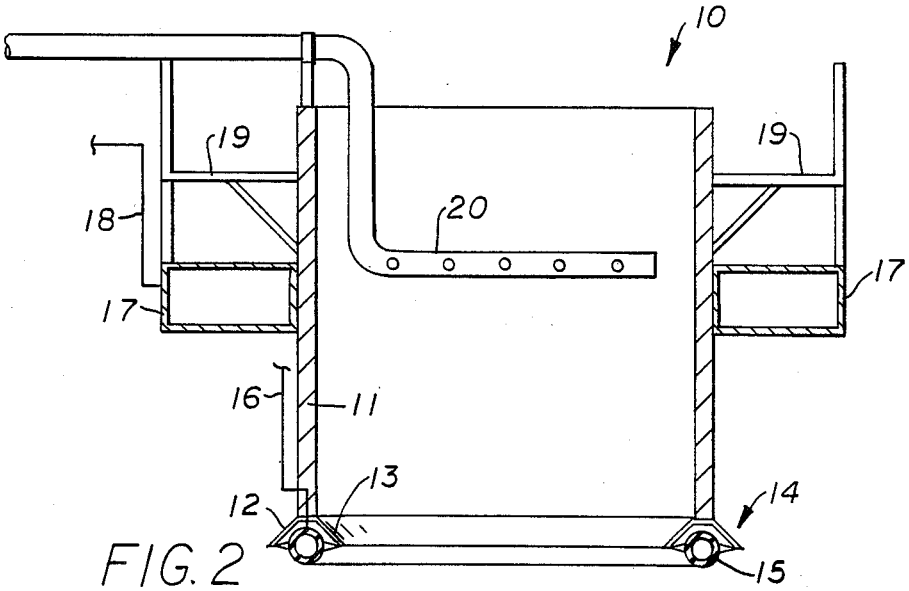
FIG. 2 is a side elevation in cross section of the isolation chamber taken along line 2—2 of FIG. 1.

Referring to the drawings by numerals of reference, there is shown in FIGS. 1, 2, and 3, a preferred isolation chamber 10 which may be preconstructed and/or preassembled at the job site on the side of a hydraulic containment pond. Isolation chamber 10 comprises an open ended cylindrical housing 11 constructed of a suitable water impervious material such as aluminum or steel. The diameter of housing 11 is determined by the size of the repair to be performed on the synthetic liner and its height is greater than the working depth of the repair area.

A pair of diverging side walls 12 and 13 extend downward and outward from the bottom of housing 11 to form a skirt-like base 14 which encircles the bottom of the housing. A flexible deformable seal 15 is located within base 14 of housing 11. Seal 15 comprises a hollow tubular member of flexible deformable material formed into a continuous ring. A hydraulic line 16 communicates the seal interior to one or more pumps (not shown) for selectively supplying air or water under pressure to the seal interior.

A hollow ballast tank 17 is constructed to encircle the outer circumference of chamber housing 11 at an elevation such that injection or displacement of water inside the tank will sink or float the chamber. A hydraulic line 18 and pump (not shown) connects the interior of ballast tank 17 to a source of clean water.

A working platform 19 or scaffold walkway may be constructed to encircle housing 11 at a convenient distance above ballast tank 17 and in close proximity to the top of the housing to permit workmen easy access into the top of the housing and provide a convenient location for storage of equipment and the like.

A clean water supply tube 20 extends into the interior of housing 11 and is connected through a pump (not shown) to a source of supply for filling the housing interior with clean water. A pump P may also be operatively connected to the interior of the housing 11 for removing contaminated water and sediment from the interior of said housing when resting on the liner at the bottom of the body of water.

From the foregoing description it should be understood that the isolation chamber may be preconstructed outside the pond, lowered into the pond, and floated to a predetermined location and sunk into position as will be described hereinafter.

OPERATION

Figure 4:
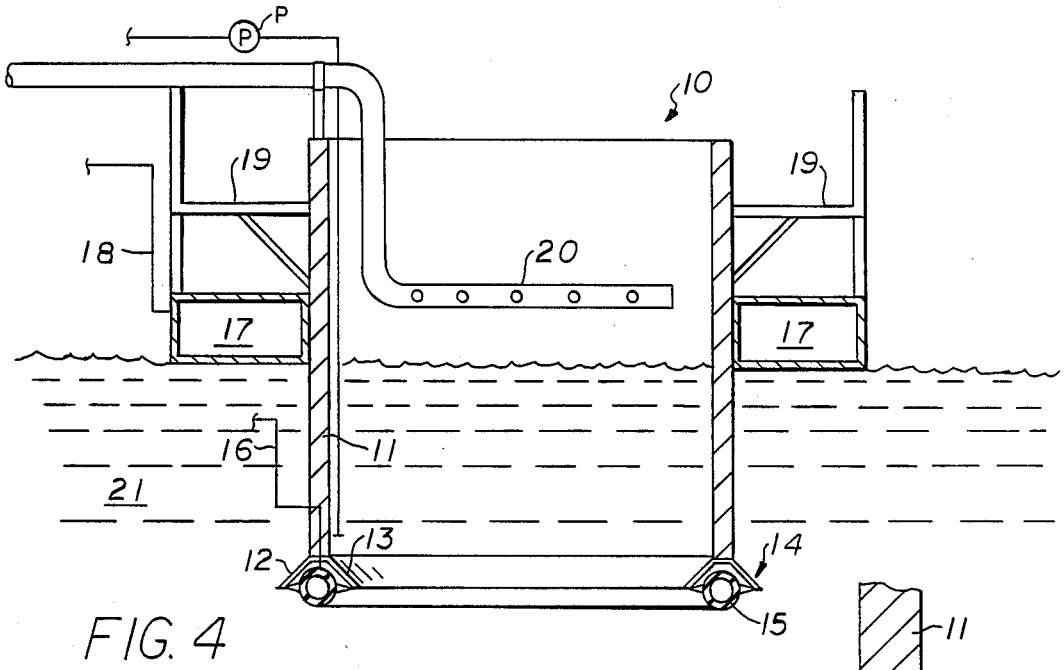
FIG. 4 is a schematic side elevation of the isolation chamber being floated to the repair site of the liner.

After the isolation chamber has been assembled and connections are made to the air and water supply sources, ballast tank 17 and base seal 15 are filled with air. The assembled isolation chamber 10 is lowered into the hazardous water 21 of the pond and floated to the location above the section of the liner to be repaired (FIG. 4).

Figure 5:
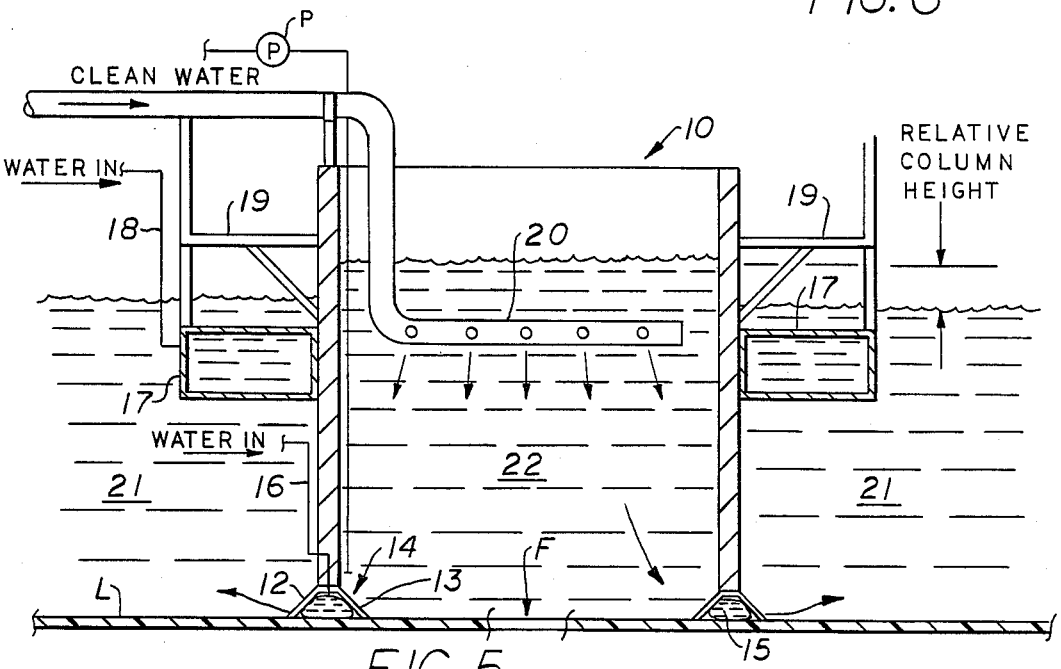
FIG. 5 is a schematic side elevation of the isolation chamber sunk into position surrounding the repair site and filled with clean water.

When properly positioned above the repair site, the air in ballast tank 17 is displaced with clean water and the isolation chamber will sink to the bottom of the pond with base 14 of cylindrical housing 11 surrounding the failure F in the liner L. (FIG. 5)

Figure 6:
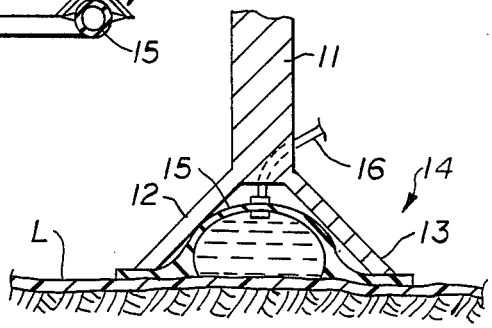
FIG. 6 is partial cross section of the base seal of the isolation chamber in the filled condition.

After isolation tank 10 is resting in the proper working location, the air in flexible deformable tubular seal 15 at the base of housing 11 is displaced with water. As water fills seal 15, it conforms closely to the liner surface on which it is resting and substantially reduces any surface variations and fills irregularities between the base of the housing and the floor of the lined pond. (FIG. 6)

Clean water is then injected into the center of isolation chamber housing 11 at a predetermined rate. A leak rate through base seal 15 is calculated as a function of the inlet flow rate verses relative column heights between water inside and the water outside of the isolation chamber housing. Thus, the clean water flushes or gradually displaces the contaminated water inside the housing and the ratio of the inlet rate to the leakage rate provides a column of continuous clean water within the housing.

A pump P may also be operatively connected to the interior of housing 11 to remove contaminated water at a predetermined rate from the interior of the housing when resting on the liner as clean water is being conducted into the interior of the housing. The rate of removal allows clean water to flush or gradually displace the contaminated water within the housing and provides a column of continuous clean water within the housing.

As the relative column height rises inside the isolation chamber housing, tests are conducted on the water quality inside the isolation area (housing interior). The results of the testing will determine the inlet flow rate necessary to maintain a non-toxic condition inside the isolation chamber, and the necessity of further sealing of areas between the flexible deformable base seal and the pond liner. If further sealing is required, hydraulic flow rates can be reduced by conventional chemical sealing techniques at the point of leakage.

When the water quality within housing 11 is determined to be acceptable for human contact, and when the water clarity is acceptable, the chamber has performed its primary function of providing a barrier between clean water 22 injected into the isolation chamber and the surrounding hazardous or unclean water 21. Isolation of clean water in the contaminated pond environment permits entry into the isolation chamber by divers and the clean water has improved clarity for allowing divers to work with good visibility in the isolated area.

Divers may now enter the water environment of the isolation chamber and dive to the predetermined work area which has been sealed off sufficient to prevent them from contacting the contaminated water. The synthetic plastic liner failure can then be identified and repaired.

Although many various types of repair operations may be performed in the safe working environment thus created, two preferred repair techniques using a mechanical batten and splicing procedure are described below.

Figure 7:
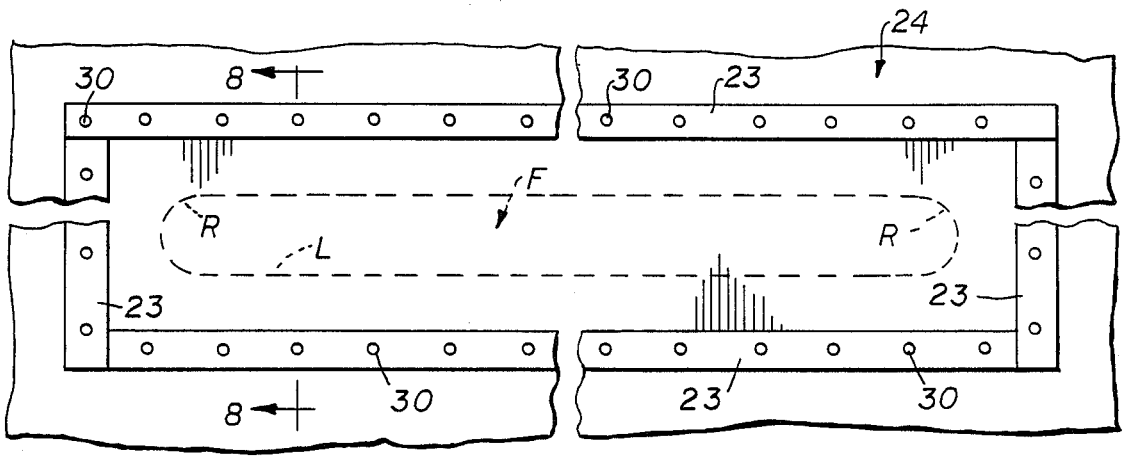
FIGS. 7 and 8 show a mechanical batten liner repair technique utilizing flat bars and gasket materials.
Figure 8:
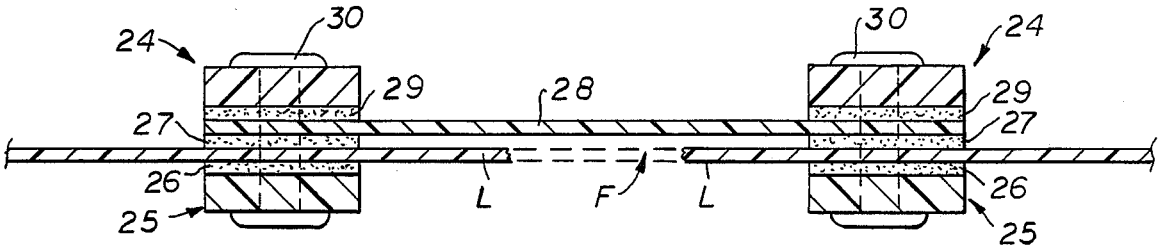

FIGS. 7 and 8 show a portion of a repaired liner using a mechanical batten repair technique which utilizes flat bars and gasket materials. The area of the damaged liner is identified and floatation markers are placed at the extreme edges of the repair area. If the sub-base of the pond has eroded, it is repaired by conventional grouting methods and contoured to a flat surface. The extreme ends of the damaged liner L are cut to form a smooth rounded radius R and the liner surface surrounding the area of seam joint repair is roughened. The exposed scrim material of the existing liner is coated with a thin layer of suitable structural adhesive material and allowed to set.

Liner L is positioned to lie flat at the area of repair. Flat rectangular bar material 23 approximately 3" wide is cut in lengths to form an upper 24 and lower frame 25 to surround the damaged area F. A preferred material for the bar stock is a suitable reinforced fiberglass. Lengths of a suitable waterproof gasket material are also cut to the same size as the bars. There will be a three layers of gasket material. The bars of lower frame 25 are placed under liner L and a lower layer of gasket material 26 is placed on top of lower bars 25. An intermediate layer of gasket material 27 is placed on top of damaged liner L directly above lower bars 25 and lower gasket 26 to surround the damaged area.

A strip of replacement liner material 28 is cut to fit the outer periphery of intermediate gasket 27 and placed over the intermediate gasket 27. An upper layer of gasket material 29 is placed over replacement liner strip 28 just inside the outer periphery and upper frame bars 24 are placed on top of upper gasket material 29. Holes are punched through the layers of flat bars and gasket material and suitable fasteners 30, such as brass or thermoplastic bolts and nuts, are installed through the holes. Fasteners 30 are tightened to compress the gasket material and effect a water-tight seal surrounding the replacement liner strip 28.

Figure 9:
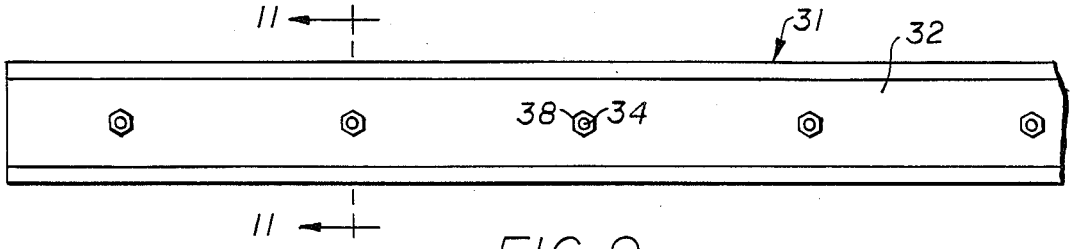
FIGS. 9, 10, and 11 show a mechanical batten liner repair technique utilizing channel members and adhesive materials.
Figure 10:
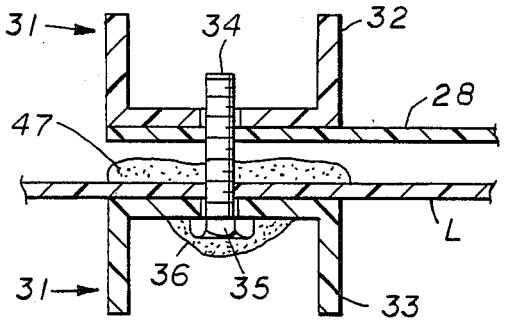
Figure 11:
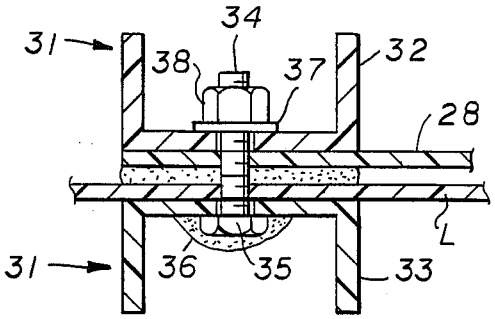

FIGS. 9, 10, and 11 show a portion of a repaired liner using another mechanical batten repair technique which utilizes channel members and the injection of a structural adhesive between the damaged liner and the replacement liner strip. The area of the damaged liner is identified and floatation markers are placed at the extreme edges of the repair area. If the sub-base of the pond has eroded, it is repaired by conventional grouting methods and contoured to a flat surface. The extreme ends of the damaged liner are cut to form a smooth rounded radius and the liner surface surrounding the area of seam joint repair is roughened. The exposed scrim material, if any, of the existing liner is coated with a thin layer of suitable structural adhesive material and allowed to set.

Damaged liner L is positioned to lie flat at the area of repair. U-shaped channel members 31 approximately 3" wide are cut in lengths to form an upper 32 and lower frame 33 to surround the damaged area. A preferred material for the channel members is a suitable reinforced fiberglass. As seen in FIGS. 10 and 11, lower U-shaped channel member 33 is inverted and has a plurality of holes drilled through the center section and each receives a bolt 34. The bolt heads 35 are secured to the underside of the center section of the lower channel by a suitable epoxy 36 with the shafts extending upward. The lower channel members 33 are placed under damaged liner L and the liner is punctured to receive the bolt shafts through the liner.

A strip of replacement liner material 28 is cut to fit the outer periphery of lower channel members 33. The replacement strip 28 is punctured corresponding to the bolt shafts and placed over the shafts.. The upper U-shaped channel members 32 are provided with holes corresponding to the bolt shafts in lower channel members 33 and are placed over the replacement liner L with the bolt shafts received in the holes. Washers 37 and nuts 38 are installed on the bolt shafts leaving enough clearance for at least a ½" vertical gap between the damaged liner L and replacement strip 28. The preferred nut, bolt and washer material is a suitable thermoplastic.

After the structural adhesive material has cured, all the connections are visually checked for integrity. A white or yellow water soluble dye is injected at low velocities adjacent to the top of the completed seam repair (FIGS. 10 and 11). The dye may be observed moving from the contained area through the repair to the exposed area below the liner. Any areas of identified leakage are marked with yellow oil base markers.

If any leakage areas are detected, the nuts within the areas of leakage are removed, the assembled channel members are disassembled and the leakage area is then cleaned and the installation of another replacement liner strip is carried out according to the procedures described above and re-tested until no leakage is detected.

Completion of the repair permits the divers to leave the isolation chamber and the chamber may be lifted from the liner by injecting air and displacing water in the ballast tanks. The isolation chamber may then be towed to another location for another repair operation, or removed from the pond.

While this invention has been described fully and completely with special emphasis upon a preferred embodiment, it should be understood that within the scope of the appended claims the invention may be practiced otherwise than as specifically described herein.

I claim:

1. A working chamber for repairing damaged liners beneath a body of contaminated water comprising;

a floatable open ended housing having a side wall formed of water impervious material configured to surround an area of liner damage and having a height greater than the depth of the body of water at the repair site, means to sink said housing to rest its bottom end on the liner at the bottom of the body of water, seal means on the bottom end of said housing for engaging and sealing the liner surface surrounding the area of liner damage, and means operable in use to conduct clean water into the interior of said housing at a predetermined rate to displace contaminated water inside said housing and to provide a column of continuous clean water within said housing sufficiently safe for human divers to enter said housing and repair the damaged liner.

2. A working chamber according to claim 1 in which said means to sink said housing comprises controlled floatation means on said housing disposed between the top and bottom ends thereof to float said housing in said body of water in a stable upright position and operable to sink said housing to rest its bottom end on the liner at the bottom of the body of water, said seal means on the bottom end of said housing comprises a controllable seal for engaging the liner surface surrounding and sealing the area of liner damage, and said water conducting means comprises conduit means adapted to be connected between a source of clean water and the interior of said housing and is cooperable in use with said seal means to maintain said column of continuous clean water within said housing sufficiently safe for human divers to enter said housing and repair the damaged liner.

3. A working chamber according to claim 2 in which said controlled seal means has a predetermined rate of leakage calculated as a function of the flow of clean water into the housing interior verses the relative column height between the water inside said housing and the contaminated body of water outside said housing to flush or gradually displace the contaminated water within said housing to provide a column of continuous clean water within said housing sufficiently safe for human divers to enter said housing and repair the damaged liner.

4. A working chamber according to claim 2 including pump means operatively connected to the interior of said housing for removing contaminated water from the interior of said housing when resting on the liner at the bottom of the body of water.

5. A working chamber according to claim 2 including pump means operatively connected to the interior of said housing for removing contaminated water at a predetermined rate from the interior of said housing when resting on the liner at the bottom of the body of water as clean water is being conducted into the interior of said housing, whereby the rate or removal allows clean water to flush or gradually displace the contaminated water within said housing to provide a column of continuous clean water within said housing sufficiently safe for human divers to enter said housing and repair the damaged liner.

6. A working chamber according to claim 2 in which said controlled floatation means comprises a hollow ballast tank operatively connected by pump means to a source of air and clean water such that injection of air thereinto will cause said housing to float and displacement of the air with water will sink said housing.

7. A working chamber according to claim 2 in which said controlled seal means comprises a hollow flexible deformable seal extending along the bottom edge of said housing and operatively connected by pump means to a source of air and clean water such that injection of water thereinto will cause the seal to closely conform to the liner surface on which it is resting to substantially reduce surface variations and fill irregularities between the bottom edge of said housing and the liner surface, and displacement of the water therein with air will inflate said seal sufficient to break the sealing relation with the liner surface and allow said housing to be lifted from the liner.

8. A working chamber according to claim 2 including a working platform on said housing above said floatation means and in close proximity to the top of said housing for facilitating entry of divers thereinto and providing a means for storage of equipment and the like.

9. A working chamber according to claim 2 in which said housing is a hollow cylindrical configuration having a skirt at its bottom end, and said controlled seal means is contained within said skirt.

10. A working chamber according to claim 9 in which said skirt comprises an inverted generally V-shaped configuration having downwardly and outwardly diverging side walls.

11. A working chamber according to claim 2 in which said housing is a hollow cylindrical configuration, and said controlled floatation means encircles the outer circumference of said housing.

12. A method of repairing damaged liners beneath a body of contaminated water comprising the steps of;

providing a working chamber in the form of an open ended housing having a side wall formed of water impervious material configured to surround the area of liner damage and having a height greater than the depth of the body of water at the repair site, sinking said chamber to rest its bottom end on the liner at the bottom of the body of water surrounding the damaged area, providing a seal between the bottom of said chamber and said liner, filling the interior of said chamber with clean water at a predetermined rate to displace contaminated water inside the chamber while allowing leakage at a predetermined rate through said seal to provide a column of continuous clean water within the chamber sufficiently safe for human divers to enter the chamber and repair the damaged liner, testing the water quality inside said chamber as the relative column height rises inside the chamber to determine the inlet flow rate necessary to maintain a non-toxic condition inside the chamber and the necessity of further sealing of areas between the flexible deformable seal means and the liner, and after the water quality within the chamber is determined to be acceptable for human contact and the water clarity is acceptable, sending divers into the chamber to perform repair operations on the damaged liner.

13. A method according to claim 12 wherein the repair operations performed by the divers comprise patching said liner.

14. A method according to claim 12 wherein the repair operations performed by said divers comprise the steps of;

(A) entering the chamber and diving to the area of the liner damage, (B) placing floatation markers at the extreme edges of the repair area, (C) inspecting the sub-base of the pond beneath the liner and if eroded, repairing it by conventional grouting methods and contouring it to a flat surface, (D) cutting the extreme ends of the damaged liner to form a smooth rounded radius, (E) roughening the surface of the liner surrounding the area of seam joint repair and coating the exposed scrim material of the liner with a thin layer of structural adhesive material and allowing it to set, (F) positioning the liner to lie flat at the area of repair, (G) cutting flat rectangular bar material in predetermined lengths to form an upper and lower frame to surround the damaged area, (H) cutting waterproof gasket material in lengths corresponding the upper and lower frame bar members to form three layers between the upper and lower bar members, (I) placing the bars of the lower frame under the liner and a lower layer of gasket material on top of the lower bars, (J) placing an intermediate layer of gasket material on top of the damaged liner directly above the lower bars and lower gasket material to surround the damaged area, (K) cutting a strip of replacement liner material to fit the outer periphery of the intermediate gasket material and placing it over the intermediate gasket material, (L) placing an upper layer of gasket material over the replacement liner strip just inside the outer periphery, (M) placing the upper frame bars on top of the upper gasket material, (N) forming holes through the assembled layers of flat bars and gasket material, and (O) installing fasteners through the holes and tightening them to compress the gasket material and effect a watertight seal surrounding the replacement liner strip.

15. A method according to claim 12 wherein the repair operations performed by the divers comprise the steps of;

(A) entering the chamber and diving to the area of the liner damage, (B) placing floatation markers at the extreme edges of the repair area, (C) inspecting the sub-base of the pond beneath the liner and if eroded, repairing it by conventional grouting methods and contouring it to a flat surface, (D) cutting the extreme ends of the damaged liner to form a smooth rounded radius, (E) roughening the surface of the liner surrounding the area of seam joint repair and coating the exposed scrim material of the liner with a thin layer of structural adhesive material and allowing it to set, (F) positioning the liner to lie flat at the area of repair, (G) cutting U-shaped channel members in predetermined lengths to form an upper and lower frame to surround the damaged area, (H) forming a plurality of longitudinally spaced holes through the center section of the channel members, (I) inverting the lower U-shaped channel members and securing bolts through the holes with the bolt heads beneath the center section and the shafts extending upward, (J) placing the lower inverted U-shaped channel members under the damaged liner, forming holes in the liner corresponding to the bolt shafts and placing the liner on the lower channel member with the bolts extending through the liner, (K) cutting a strip of replacement liner material to fit the outer periphery of the lower channel members and forming holes in the replacement strip corresponding to the bolt shafts, (L) placing the replacement strip over the shafts, (M) placing the upper U-shaped channel members over the replacement strip with the bolt shafts received in the holes of the upper channel members, (N) installing washers and nuts on the ends of the bolt shafts leaving enough clearance for at least a $\frac{1}{2}''$ vertical gap between the damaged liner and the replacement strip, (0) injecting structural adhesive in a bead not less than $\frac{1}{4}''$ diameter in the gap between the damaged liner and the replacement strip, (P) tightening the nuts to compress the adhesive material and effect a watertight seal between the outer edged of the replacement liner strip and the damaged liner, (Q) after the structural adhesive material has cured, injecting a white or yellow water soluble dye adjacent the repaired area, visually inspecting movement of the dye relative to the repair to determine the repair integrity, and marking any areas of leakage with colored oil base markers, (R) if leakage areas are detected, removing the nuts within the areas of leakage, disassembling the channel members, cleaning the leakage area, and repeating steps L through Q until no leakage is detected.

16. A method of repairing damaged liners beneath a body of contaminated water comprising the steps of;

(A) providing a working chamber in the form of an open ended housing having a side wall formed of water impervious material configured to surround the area of liner damage and having a height greater than the depth of the body of water at the repair site, controlled hydraulic floatation means thereon between the top and bottom ends thereof for floating the chamber in said body of water in a stable upright position and operable to sink said chamber to rest its bottom end on the liner at the bottom of the body of water, controlled hydraulic flexible deformable seal means on the bottom end of said chamber for engaging the liner surface surrounding the area of liner damage and forming a substantial water sealing relation therewith, and conduit means connected between a source of clean water and the interior of said chamber for conducting clean water into the interior of said chamber at a predetermined rate to displace contaminated water inside said housing, (B) filling the hydraulic floatation means and seal means with air and placing the working chamber in the body of contaminated water and floating the working chamber to a location above the section of the liner to be repaired, (C) displacing the air in the floatation means with a quantity of clean water sufficient to sink the chamber to rest its bottom end on the liner at the bottom of the body of water surrounding the damaged area, (D) displacing the air in the hydraulic seal with a quantity of clean water to flex it sufficient to closely conform to the liner surface on which it is resting and substantially reduce surface variations and fill irregularities between the bottom of the chamber and the liner and form a substantial water sealing relation therewith with a predetermined rate of leakage, (E) filling the interior chamber with clean water at a predetermined rate to displace contaminated water inside the chamber while allowing leakage at a predetermined rate through said hydraulic seal means to provide a column of continuous clean water within the chamber sufficiently safe for human divers to enter the chamber and repair the damaged liner, the rate of leakage of said seal means being calculated as a function of the inlet flow rate of the clean water verses the relative column height between the clean water inside the chamber and the contaminated water outside the chamber, (F) testing the water quality inside the chamber as the relative column height rises inside the chamber to determine the inlet flow rate necessary to maintain a non-toxic condition inside the chamber and the necessity of further sealing of areas between the flexible deformable seal means and the liner, (G) reducing the rate of leakage through said seal means if further sealing is required by conventional chemical sealing techniques at the point of leakage, and (H) after the water quality within the chamber is determined to be acceptable for human contact and the water clarity is acceptable, sending divers into the chamber to perform repair operations on the damages liner.

17. The method according to claim 16 including the further steps of;

(I) providing pump means operatively connected to the interior of the chamber, and (J) pumping contaminated water at a predetermined rate from the interior of the chamber when resting on the liner at the bottom of the body of water and as clean water is being conducted into the interior of the chamber, whereby the rate of removal allows clean water to flush or gradually displace the contaminated water within the chamber to provide a column of continuous clean water within the chamber sufficiently safe for human divers to enter the chamber and repair the damaged liner.

18. method according to claim 16 wherein the repair operations performed by the divers comprise the steps of;

(A) entering the chamber and diving to the area of the liner damage, (B) placing floatation markers at the extreme edges of the repair area, (C) inspecting the sub-base of the pond beneath the liner and if eroded, repairing it by conventional grouting methods and contouring it to a flat surface, (D) cutting the extreme ends of the damaged liner to form a smooth rounded radius, (E) roughening the surface of the liner surrounding the area of seam joint repair and coating the exposed scrim material of the liner with a thin layer of structural adhesive material and allowing it to set.

(F) positioning the liner to lie flat at the area of repair, (G) cutting flat rectangular bar material in predetermined lengths to form an upper and lower frame to surround the damaged area, (H) cutting waterproof gasket material in lengths corresponding the upper and lower frame bar members to form three layers between the upper and lower bar members, (I) placing the bars of the lower frame under the liner and a lower layer of gasket material on top of the lower bars, (J) placing an intermediate layer of gasket material on top of the damaged liner directly above the lower bars and lower gasket material to surround the damaged area, (K) cutting a strip of replacement liner material to fit the outer periphery of the intermediate gasket material and placing it over the intermediate gasket material, (L) placing an upper layer of gasket material over the replacement liner strip just inside the outer periphery, (M) placing the upper frame bars on top of the upper gasket material, (N) forming holes through the assembled layers of flat bars and gasket material, and (O) installing fasteners through the holes and tightening them to compress the gasket material and effect a watertight seal surrounding the replacement liner strip.

19. The method according to claim 16 wherein the repair operations performed by the divers comprise the steps of;

(A) entering the chamber and diving to the area of the liner damage, (B) placing floatation markers at the extreme edges of the repair area, (C) inspecting the sub-base of the pond beneath the liner and if eroded, repairing it by conventional grouting methods and contouring it to a flat surface, (D) cutting the extreme ends of the damaged liner to form a smooth rounded radius, (E) roughening the surface of the liner surrounding the area of seam joint repair and coating the exposed scrim material of the liner with a thin layer of structural adhesive material and allowing it to set, (F) positioning the liner to lie flat at the area of repair, (G) cutting U-shaped channel members in predetermined lengths to form an upper and lower frame to surround the damaged area, (H) forming a plurality of longitudinally spaced holes through the center section of the channel members, (I) inverting the lower U-shaped channel members and securing bolts through the holes with the bolt heads beneath the center section and the shafts extending upward, (J) placing the lower inverted U-shaped channel members under the damaged liner, forming holes in the liner corresponding to the bolt shafts and placing the liner on the lower channel member with the bolts extending through the liner, (K) cutting a strip of replacement liner material to fit the outer periphery of the lower channel members and forming holes in the replacement strip corresponding to the bolt shafts, (L) placing the replacement strip over the shafts, (M) placing the upper U-shaped channel members over the replacement strip with the bolt shafts received in the holes of the upper channel members, (N) installing washers and nuts on the ends of the bolt shafts leaving enough clearance for at least a ½" vertical gap between the damaged liner and the replacement strip, (O) injecting structural adhesive in a bead not less than ¼" diameter in the gap between the damaged liner and the replacement strip, (P) tightening the nuts to compress the adhesive material and effect a watertight seal between the outer edged of the replacement liner strip and the damaged liner, (Q) after the structural adhesive material has cured, injecting a white or yellow water soluble dye adjacent the repaired area, visually inspecting movement of the dye relative to the repair to determine the repair integrity, and marking any areas of leakage with colored oil base markers, (R) if leakage areas are detected, removing the nuts within the areas of leakage, disassembling the channel members, cleaning the leakage area, and repeating steps L through Q until no leakage is detected.

* * * * *